United States Patent [19]

Buyak

[11] Patent Number: 4,864,275

[45] Date of Patent: Sep. 5, 1989

[54] SOLENOID OPERATED DOORBELL

[75] Inventor: William P. Buyak, New Hartford, Conn.

[73] Assignee: General Signal Corporation, Stamford, Conn.

[21] Appl. No.: 191,503

[22] Filed: May 9, 1988

[51] Int. Cl.[4] ..... G08B 3/00

[52] U.S. Cl. ..... 340/392; 340/384 E

[58] Field of Search ..... 340/392, 384 E, 396, 340/328, 393; 116/152, 157

[56] References Cited

U.S. PATENT DOCUMENTS

| | | | |
|---|---|---|---|
| 2,290,717 | 7/1942 | Swanson | 340/392 |
| 2,659,074 | 11/1953 | Alexander | 340/392 |
| 2,820,913 | 1/1958 | Christy | 340/392 |
| 3,246,321 | 4/1966 | Doggart | 340/392 |

*Primary Examiner*—Joseph A. Orsino
*Assistant Examiner*—Jeffery A. Hofsass
*Attorney, Agent, or Firm*—Robert R. Hubbard

[57] ABSTRACT

Doorbell mechanism that employs only one solenoid to achieve both single tone and double tone operation. The solenoiod has a split coil with the full coil being employed for double tone operation and a portion of the coil being employed for single tone operation.

3 Claims, 2 Drawing Sheets

SOLENOID OPERATED DOORBELL

BACKGROUND OF THE INVENTION

This invention relates to doorbells and in particular to a two chime doorbell that is operated by a solenoid mechanism.

A typical prior art solenoid operated doorbell is illustrated in FIGS. 1 and 2 as having first and second solenoids 10 and 11 and first and second chimes 12 and 13. Each solenoid has a support spring arranged to coact with its armature. Thus, support spring 11*a* is arranged to coact with armature 11*b* of solenoid 11 such that when energized, the armature 11*b* will be impelled downwardly to strike chime 13. Upon deenergization of the solenoid the spring drives the armature upward where it strikes the second chime. This results in a two-tone ring consisting of the sequential striking of the chime bars 13 and 12.

The other solenoid 10 is arranged to operate identically to solenoid 11. However, the ringing of the upper chime 12 is inhibited by the placement of a damper pad 14 above the solenoid 10 so that its armature strikes the damping pad 14 rather than the chime 12. This assures that only one chime (chime 13) will ring when solenoid 10 is energized.

FIG. 2 illustrates a simple circuit for operation of the doorbell from a voltage supply 15. This circuit includes a first circuit branch having a switch S1 and the coil 11*c* of solenoid 11 connected in series with the supply and a second branch consisting of a switch S2 and the coil 10C of solenoid 10 also connected in series with the supply.

This prior art doorbell has been a successful commercial product, known in the trade as Builders' Chime Kits, Catalog No. C210, available from Edwards Company, Inc. of Farmington Conn. It is to be noted that the doorbell trade is extremely competitive such that any improvement in price or manufacturing cost is highly advantageous, particularly if the doorbell provides the same single and double tone ringing operations.

BRIEF SUMMARY OF THE INVENTION

An object of the present invention is to provide a novel and improved solenoid operated doorbell mechanism.

Another object of the invention is to provide a solenoid operated doorbell mechanism that employs only a single solenoid.

Briefly, the invention is embodied in a doorbell that has first and second chimes arranged to ring in response to being impacted by the armature of a single solenoid such that the first chime rings when a first switch is closed and the first and second chimes ring sequentially when a second switch is closed. The single solenoid has a coil that is distributed over the length of the solenoid and that has first and second portions connected in series at a tap T1 and has its outer ends connected to taps T0 and T2.

BRIEF DESCRIPTION OF THE DRAWING

In the accompanying drawing, like reference characters denote like elements of structure, and.

DESCRIPTION OF PREFERRED EMBODIMENT

Figure 3:
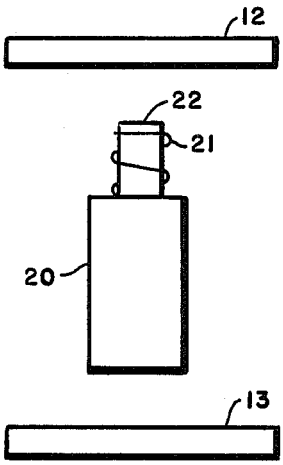
FIG. 3 is a single solenoid operated doorbell mechanism according to the present invention.
Figure 4:
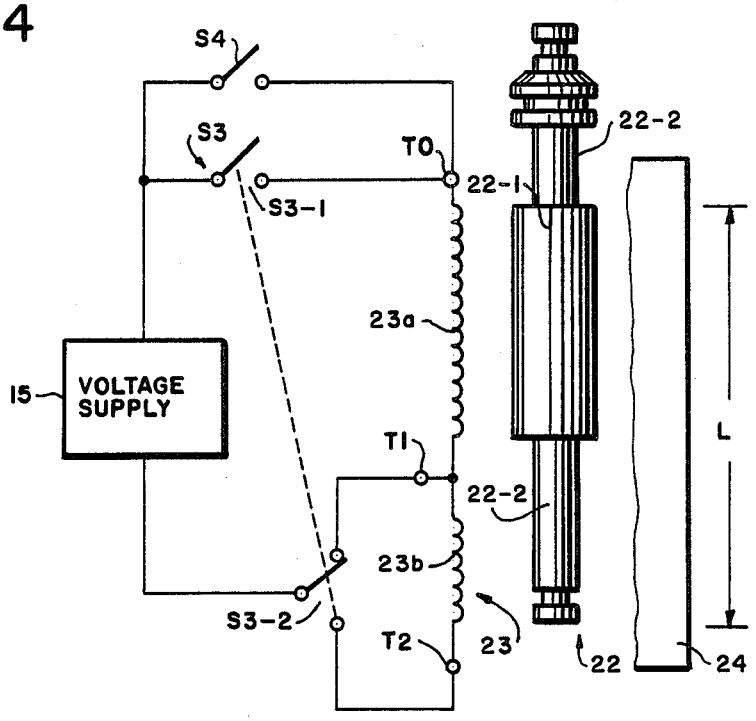
FIG. 4 is an electric circuit for the FIG. 3 doorbell mechanism.

With reference now to FIGS. 3 and 4, there is illustrated a single solenoid doorbell mechanism embodying the present invention. Like the prior art, single solenoid 20 has a support spring 21 which is arranged by means not shown to bias the solenoid armature 22 to a position offset from the geometric center of the body of solenoid 20. This assures that the two-tone operational mode will be effected upon full energization of the solenoid 20 so as to pull the armature 22 downwardly to impact chime bar 13. Upon deenergization, the support spring 22 will drive the armature upward to strike the upper chime bar 12 and will then act to return the armature to the rest position as shown in FIG. 3.

In accordance with the present invention, the solenoid has a coil 23 that is distributed along a length L of the solenoid body 24. In FIG. 4, the solenoid body 24 has been partially cut away in order to avoid clutter of the drawing. Suffice it to say that the solenoid body 24 includes within its confines the coil 23 and the armature 22.

The coil 23 has two portions, 23*a* and 23*b* connected in series at an intermediate tap T1. The outer ends of the coil 23 are connected to taps T0 and T2. The coil portion 23*a* extends over more than one-half of the length L and has more than one-half of the turns of coil 23. In one exemplary design embodying the invention, the coil portion 23*a* extends 70% of the length L and has 70% of the total turns of coil 23. Coil portion 23*b* then extends over the remainder of the coil length and has the remainder of the coil turns (30% of the length and of the turns for the exemplary design).

For double tone operation, the coil 23 is energized in its entirety. The armature 22 and spring 21 then operate exactly as in the prior art for two-tone operation. To effect this operation switch S3 (FIG. 4) is arranged to connect coil 23 in series with the voltage supply 15. Typically, the supply voltage is 12 volts AC.

To this end, switch S3 is illustrated as a ganged switch having a first pair of normally opened contacts S3-1 connected in series with the supply and the tap T0 and a second set of contacts S3-2 arranged to connect either coil portion 23*a* or 23*b* in circuit with the supply. For the case where contacts S3-1 are open, contacts S3-2 connect tap T1 and coil portion 23*a* in series with the supply. On the other hand, when switch S3 is closed, contacts S3-1 close and contacts S3-2 are operated to the other or lower position so as to connect tap T2 and the entire coil 23 in series with the supply. This then results in energization of the entire coil 23 for the double-tone operational mode.

For single-tone operation, only coil portion 23*a* is energized. The circuit for effecting this operation includes switch S4 arranged in series with coil portion 23*a* via tap T0, tap T1, and the normally open position of contacts S3-2 and the supply. This then will result in an energization of only coil portion 23*a*.

Figure 1:
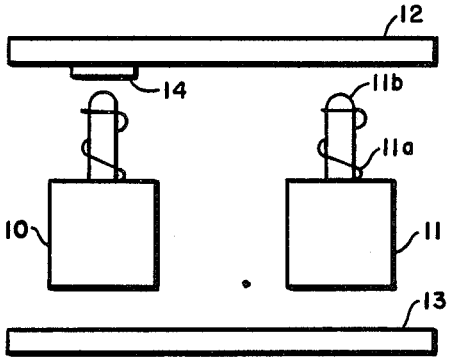
FIG.1 PRIOR ART
FIG. 1 is an elevational view of a prior art solenoid operated doorbell mechanism.
Figure 2:
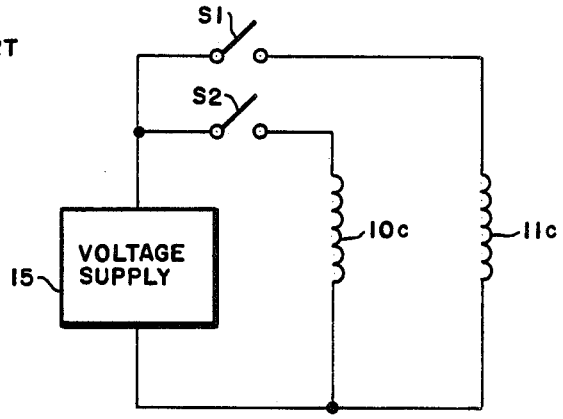
FIG.2 PRIOR ART
FIG. 2 is an electrical circuit for the prior art doorbell mechanism of FIG. 1.

The magnetic center of coil 23, like the prior art solenoids of FIG. 1, is the geometric center of the coil length. This assures that the solenoid armature will strike both the upper and lower chime bars 12 and 13 in sequence when coil 23 is energized in its entirety for the double-tone operation.

On the other hand, the magnetic center of coil portion 23*a* is essentially its geometric center which is offset from (above in FIG. 4) the geometric center of the entire coil 23. When coil 23*a* is energized, the armature is propelled downward, halting short of striking chime bar 13 due to the elevated magnetic enter and rapid decrease in magnetic flux. When coil 23*a* is de-energized, the support spring drives the armature upward striking chime bar 12. It has been found that a sufficient amount of offset to avoid striking of the lower chime 13 can be achieved with designs in which the length and turns of coil portion 23*a* are greater than 50% of the length and turns of the entire coil 23. In the previously cited exemplary embodiment, the percentage of 70% yields satisfactory operation, particularly when the armature is also shaped for sharp definition of maximum flux at or near the geometric center of coil portion 23*a*.

Figure 5:
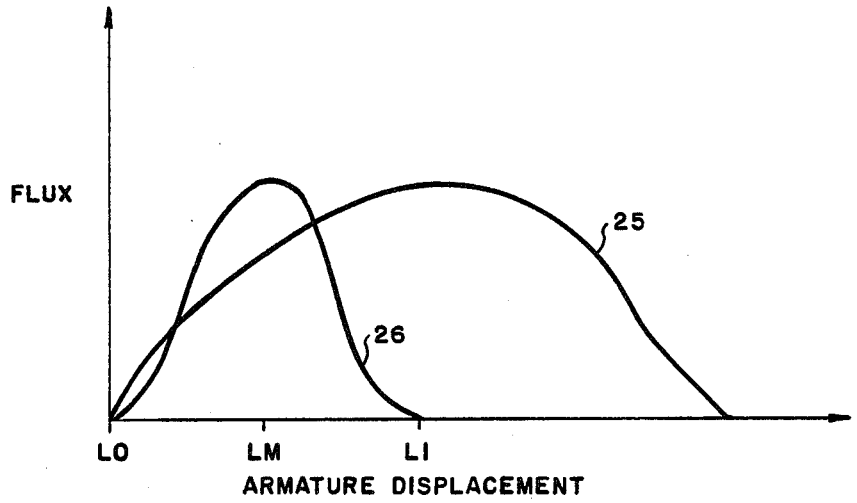
FIG. 5 is a graph of flux vs. distance for the solenoid armature of the FIG. 3 embodiment of the present invention.

In order to have consistent operation of the split coil solenoid mechanism, the solenoid armature 22 is shaped to provide a rather sharply defined maximum flux or minimum reluctance at the midpoint of coil portion 23*a*. This is achieved with an armature shape that has a main body portion 22-1 bounded at its axial extremities by outer portions 22-2. Main body portion 22-1 has a diameter greater than the diameter of the outer portions and a length that is substantially identical in length to the length of coil portion 23*a*. This armature shape helps to assure that the maximum flux or minimum reluctance point will be rather sharply defined at or about the mid-point of coil portion 23*a*. As illustrated by the graph in FIG. 5, armature flux as a function of armature displacement along the coil length has a bell-shaped curve. Curve 25 represents armature displacement for the entire coil 23 and is a rather broad flux response. That is, its magnetic center is rather difficult to precisely define as the apex of the bell curve is rather flat or broad. On the other hand, curve 26 represents coil portion 23A and has an apex which is rather sharply defined so as to occur at approximately the mid-point LM of coil portion 23A which is defined by the distance points L0 and L1. Essentially, the shaped armature feature of this invention provides a more consistent braking action of the armature so that it consistently avoids striking the lower chime 13. This serves to provide a very consistent and reliable single-tone operation.

From the preceeding description of the preferred embodiment, it is evident that the objects of the present invention are attained. Although the invention has been described and illustrated in detail, it is clearly understood that the same is by way of illustration and example only and is not to be taken by way of limitation. The spirit and scope of the present invention are to be limited only by the terms of the appended claims.

What is claimed is:

1. In a doorbell having first and second chimes arranged to ring in response to being impacted by the armature of a solenoid means such that the first chime rings when a first switch is closed and the first and second chimes ring sequentially when a second switch is closed, the improvement comprising:

the solenoid means being a single solenoid having (a) a single armature, (b) a coil that (i) is distributed over a length of the solenoid coaxial with the armature, (ii) has first and second coil portions connected in series at a tap T1 and (iii) has its outer ends connected to taps T0 and T2 and (c) a single support spring arranged to support the armature in a position offset from the center of the coil in an at rest state;

the first and second switches being connected in circuit with taps T0, T1 and T2, the solenoid means responding to operation of the second switch to sequentially ring the first and second chimes; and the length and turns of the first coil portion being greater than 50% of the length and turns of the entire coil such that the magnetic center of the first coil portion is offset from the geometric center of such solenoid length, such magnetic center offset and the armature at rest offset being such that upon closure of the first switch the solenoid armature is propelled toward and is halted short of ringing one of the chimes and upon subsequent opening of the first switch, the support spring propels the armature in the opposite direction to ring the other chime.

2. The invention according to claim 1 wherein the armature has a main body portion bounded at its extremities by outer portions, the main body portion having a diameter which is greater than the diameter of the outer portions and a length which is substantially equal to the length of the first coil portion.

3. The invention according to claim 2 wherein the length and turns of the first coil portion are approximately 70% of the length and turns of the entire coil.

* * * * *